US010422066B2

(12) United States Patent
Hwang

(10) Patent No.: US 10,422,066 B2
(45) Date of Patent: Sep. 24, 2019

(54) WASHING MACHINE

(71) Applicant: Dongbu Daewoo Electronics Corporation, Seoul (KR)

(72) Inventor: Ui Kun Hwang, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 15 days.

(21) Appl. No.: 15/499,686

(22) Filed: Apr. 27, 2017

(65) Prior Publication Data

US 2018/0087200 A1 Mar. 29, 2018

(30) Foreign Application Priority Data

Sep. 27, 2016 (KR) ..... 10-2016-0124313

(51) Int. Cl.

| | |
|---|---|
| ***D06F 35/00*** | (2006.01) |
| ***D06F 17/06*** | (2006.01) |
| *D06F 39/08* | (2006.01) |
| *D06F 23/04* | (2006.01) |
| *D06F 33/02* | (2006.01) |

(52) U.S. Cl.

CPC ..... *D06F 35/002* (2013.01); *D06F 17/06* (2013.01); *D06F 23/04* (2013.01); *D06F 33/02* (2013.01); *D06F 39/083* (2013.01); *D06F 2204/084* (2013.01); *D06F 2204/086* (2013.01)

(58) Field of Classification Search

CPC ..... D06F 35/002; D06F 17/06; B01F 3/0473

See application file for complete search history.

(56) References Cited

U.S. PATENT DOCUMENTS

| | | | | |
|---|---|---|---|---|
| 7,255,332 | B2 * | 8/2007 | Osborn | B01F 3/0473 210/221.2 |
| 9,060,916 | B2 * | 6/2015 | Cunningham | A61H 33/6036 |
| 2010/0179461 | A1 * | 7/2010 | Cunningham | A01K 13/001 601/154 |
| 2010/0199421 | A1 * | 8/2010 | Moon | A23N 12/02 4/602 |
| 2012/0159716 | A1 * | 6/2012 | Lee | D06F 35/002 8/137 |
| 2015/0176170 | A1 * | 6/2015 | Bae | D06F 35/002 68/183 |
| 2016/0305059 | A1 * | 10/2016 | Xu | D06F 39/08 |

* cited by examiner

*Primary Examiner* — Joseph L. Perrin

(57) ABSTRACT

A washing machine including a dissolving unit and a bubble generating unit. The dissolving unit includes a hollow outer body that has an open end, and a hollow inner body that has an open end. The inner body is disposed in the outer body. The gap between the inner and the outer body forms a dissolving flow path. The dissolving unit includes flow paths allowing water to mix with air efficiently as water flows through. The bubble generating unit includes a pressure reduction region to reduce pressures of bubbles. Bubbles can be supplied with washing water either to the upper side or the lower side of the tub.

15 Claims, 8 Drawing Sheets

[FIG.1]
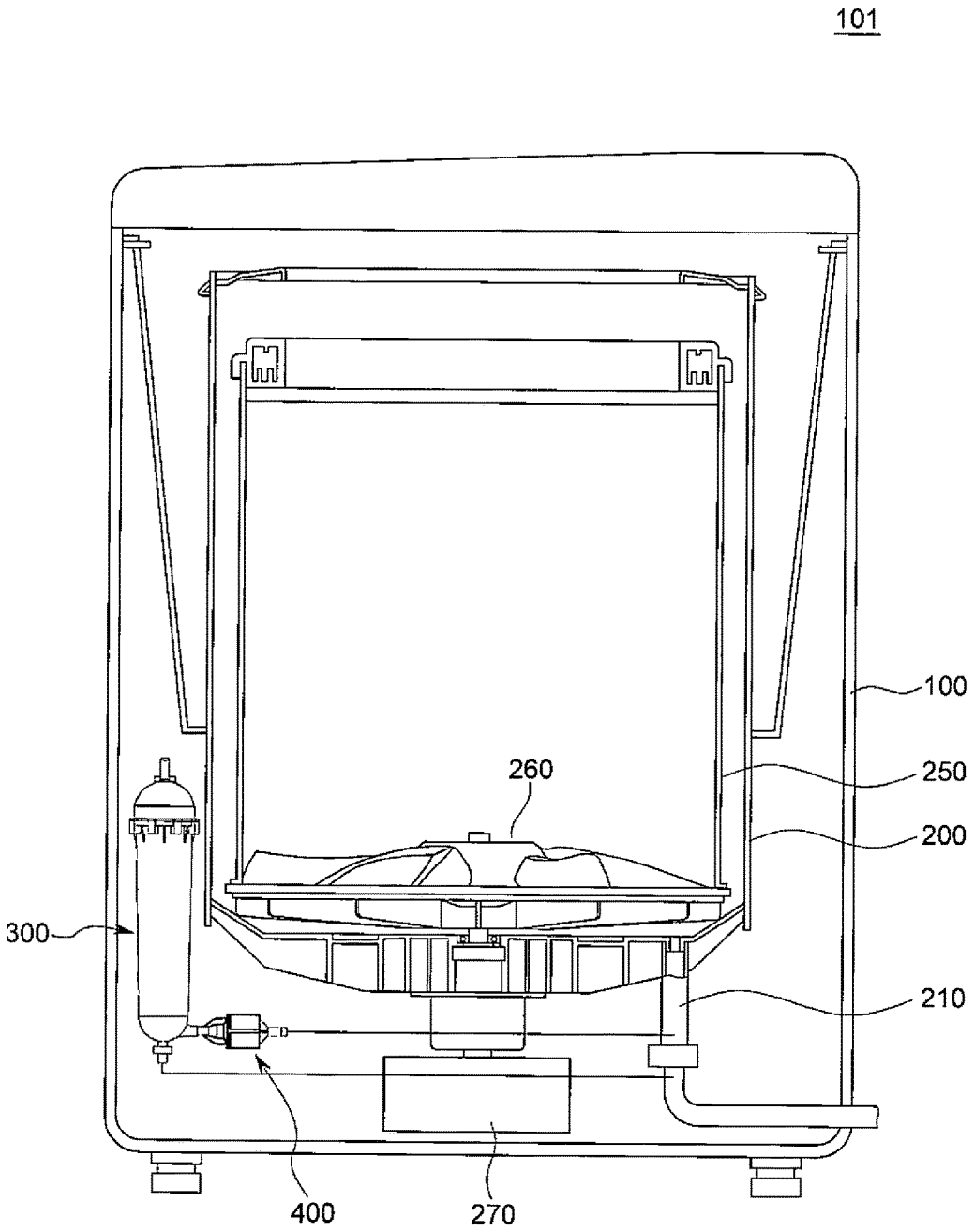

[FIG.2]
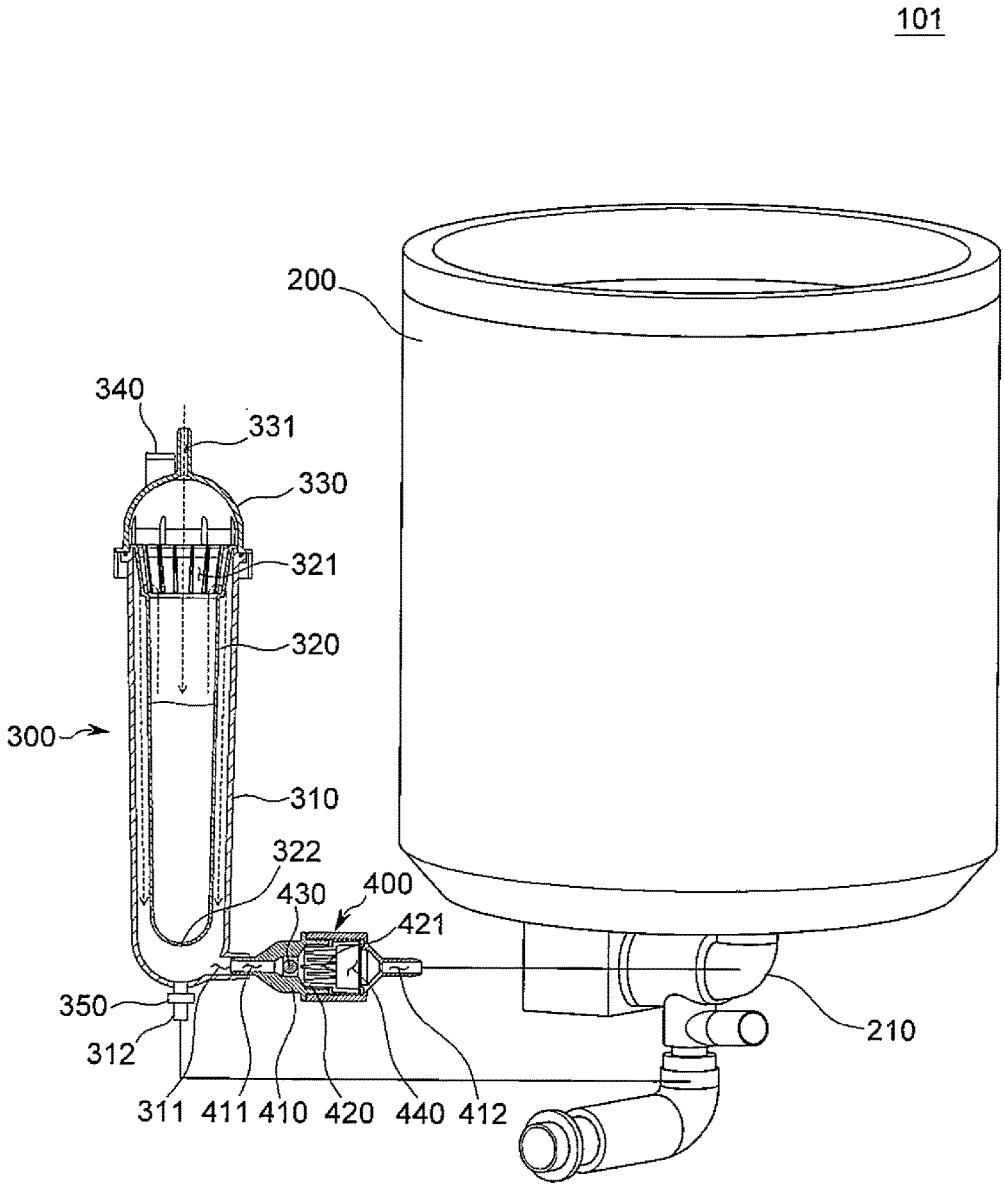

[FIG.3]
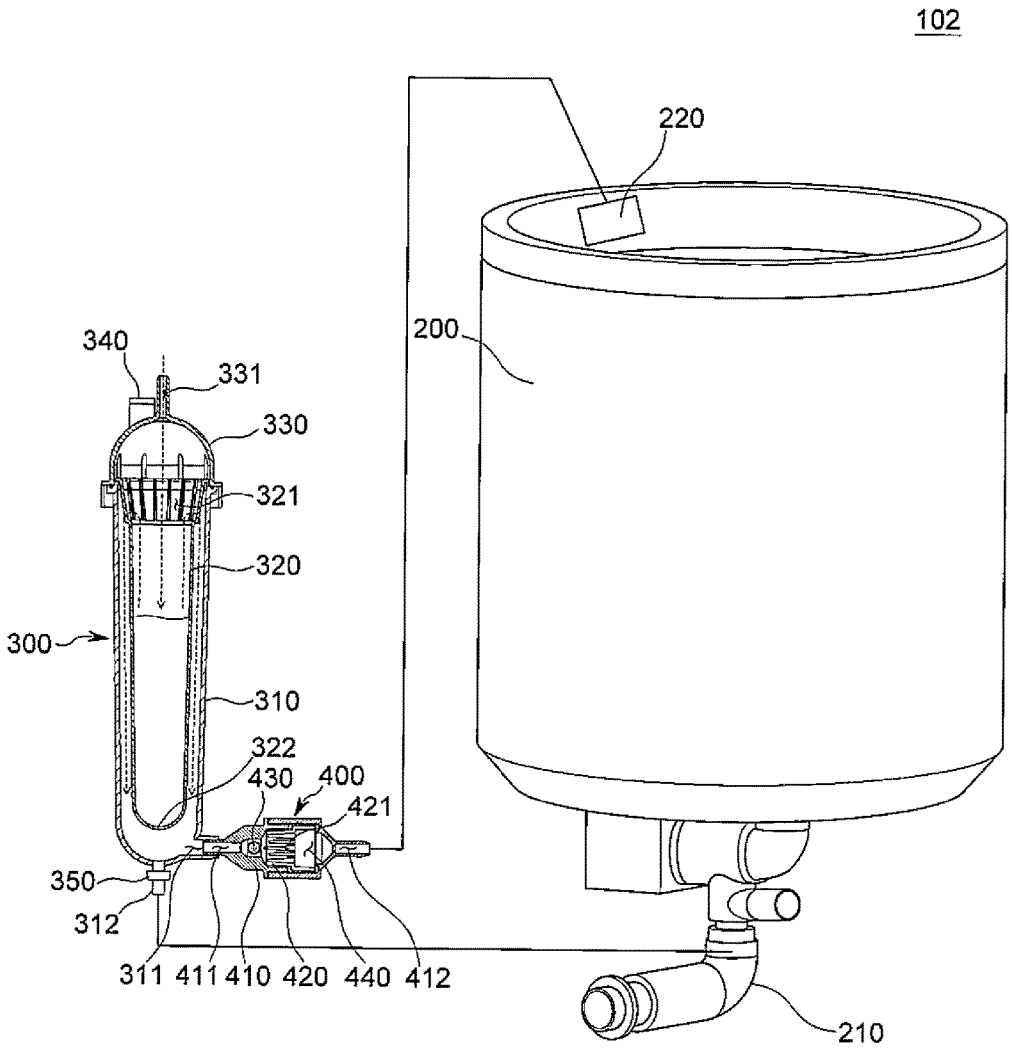

[FIG.4]
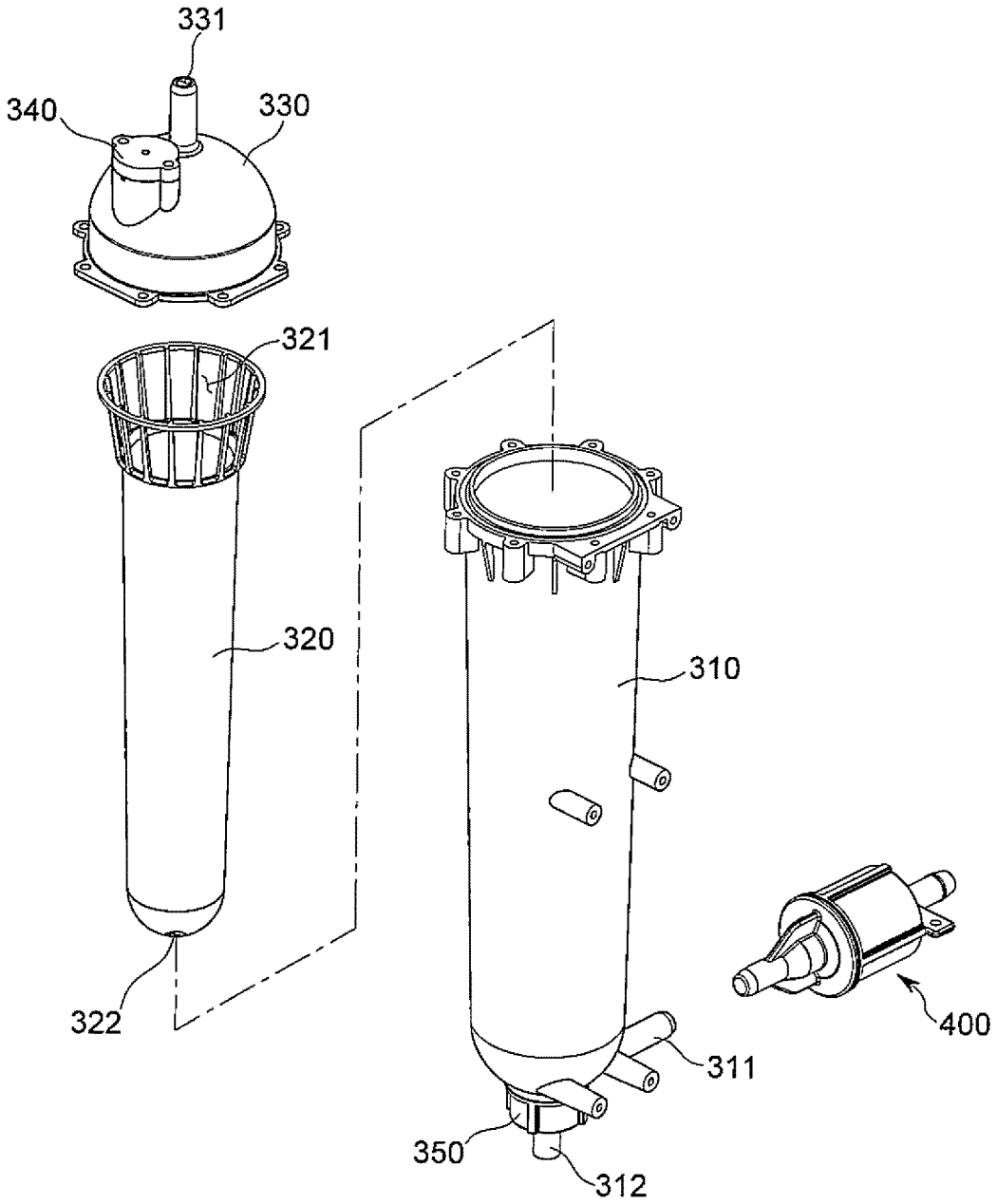

[FIG.5]
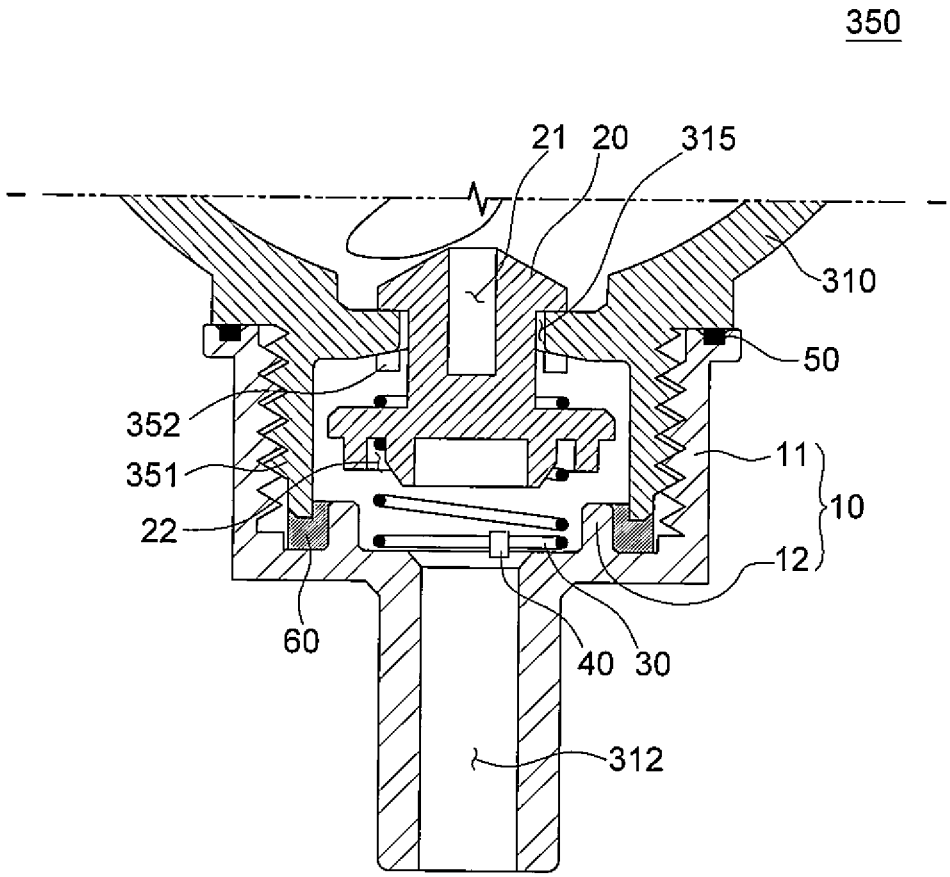

[FIG.6]
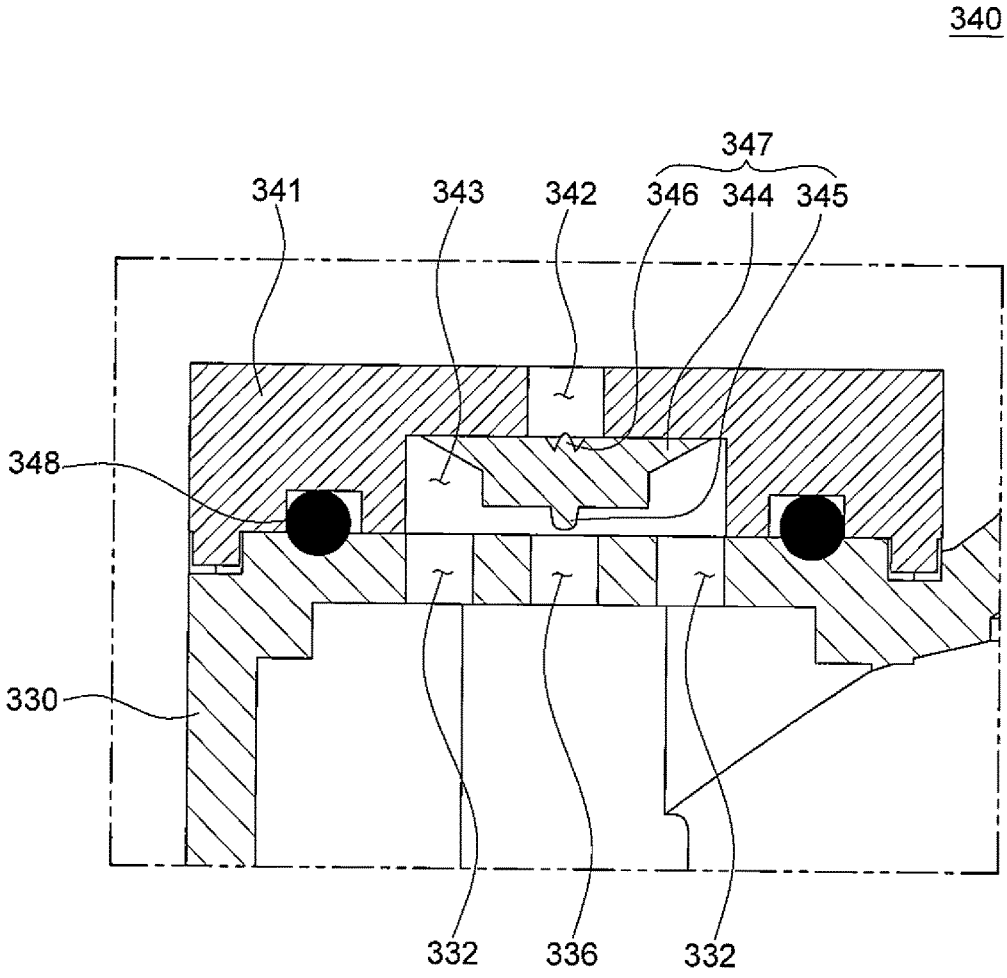

[FIG.7]
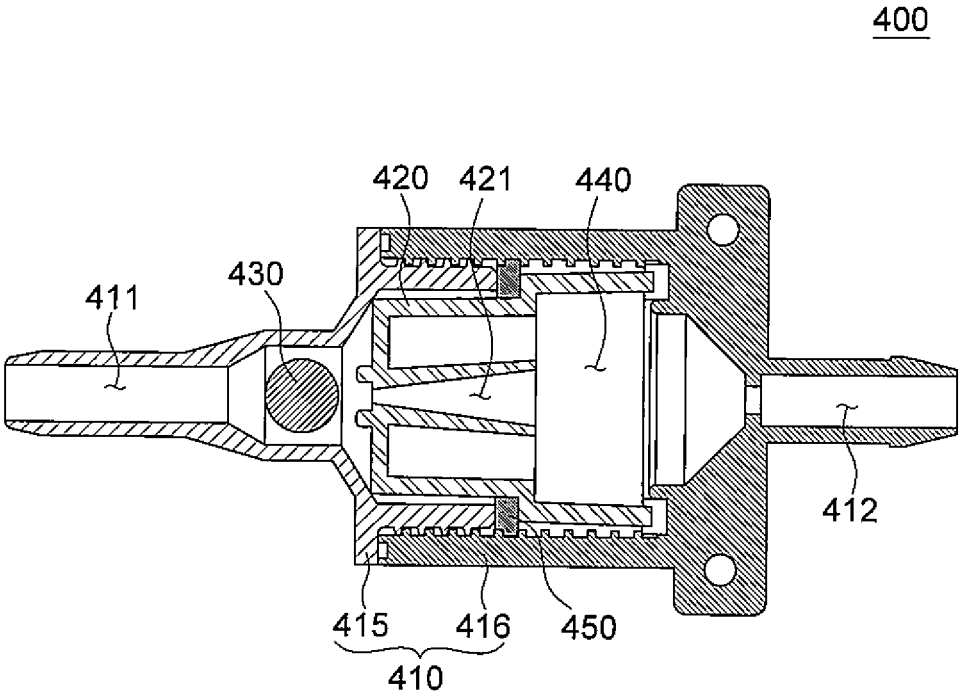

[FIG.8]
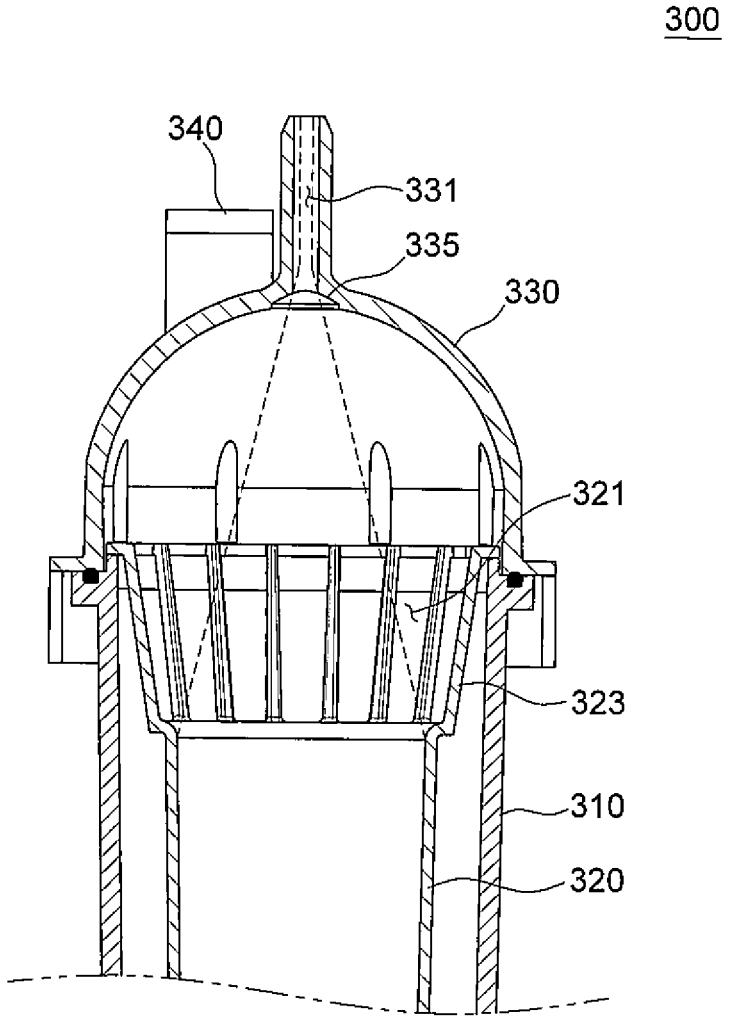

WASHING MACHINE

CROSS-REFERENCE TO RELATED APPLICATION

This application claims benefit and priority to Korean Patent Application No. 10-2016-0124313, filed on Sep. 27, 2016, with the Korean Intellectual Property Office, the disclosure of which is incorporated herein in its entirety by reference for all purposes.

TECHNICAL FIELD

Embodiments of the present disclosure relate to washing machines, and more particularly, to mechanisms that facilitate removal of residual detergent on laundry.

BACKGROUND OF THE INVENTION

Generally, a washing machine washes laundry by friction made between water and laundry when a pulsator rotates in the drum of the washing machine. Holes in the drum allow water to flow between the tub and the drum. During a washing, rinsing, or spin-drying process, water can be discharged out of the tub through a drain line, e.g., installed at a lower side of the tub.

After processing the laundry, there may be residual detergent or other foreign substances remaining on the washed clothes, which may cause an irritating skin condition of a person wearing the clothes, for example atopic dermatitis.

Various technologies have been developed to solve this problem, typically by supplying a concentrated water flow to the laundry clothes, where the flow is generated by a separate device such as a pump. Unfortunately, the operation of such a pump produces unwanted noise, and it is difficult to perform maintenance on the pump after the pump is repeatedly used.

SUMMARY OF THE INVENTION

Embodiments of the present disclosure provide a washing machine operable to generate and supply bubbles to facilitate removal of unwanted residual detergent and foreign substances undesirably adherent to laundry and thereby enhance cleaning effectiveness.

An exemplary embodiment of the present disclosure provides a washing machine, which includes a housing, and a tub installed in the housing, the washing machine including: a dissolving unit which stores air therein, and mixes water supplied from the outside with inside air so that the stored air is dissolved in the supplied water; and a bubble generating unit which generates bubbles by using the water/air mixture supplied from the dissolving unit, and supplies the bubbles into the tub.

The dissolving unit may include: an outer body which has an open first side and has a hollow interior; an inner body which has an open first side, disposed in the outer body such that an outer circumferential surface of the inner body is spaced apart from an inner circumferential surface of the outer body and forms a dissolving flow path; a dissolving cap which is coupled to the first side of the outer body, and has a dissolving inlet port to receive water supplied from the outside to the inner body; a porous portion which is formed in one area of the inner body; and a dissolving guide port which is disposed in the outer body, and guides the water passed through the dissolving flow path to the bubble generating unit.

The water introduced into the dissolving inlet port of the washing machine may be introduced into the inner body so that a level of water is increased. Water can flow along an inner wall of the inner body, pass through the porous portion, overflow to the dissolving flow path. During the course of flow, water can be mixed with air stored in the dissolving unit.

The dissolving unit may further include a dissolving drain port which is disposed in the outer body and disposed apart from the dissolving guide port, and guides water stored in the outer body so that the water is discharged through a drain line of the tub when the amount of water stored in the outer body is equal to or greater than a predetermined amount.

The dissolving unit may further include an air supply check valve which is installed in the dissolving cap, and can open when water is discharged to the drain line of the tub through the dissolving drain port, such that air is introduced into the outer body and the inner body.

The bubble generating unit may include: a bubble body which includes a bubble inlet port disposed at the first side thereof, and a bubble discharge port disposed at the second side thereof; and a bubble nozzle which is disposed inside the bubble body, and has a bubble flow path that has an inner diameter increasing from the bubble inlet port to the bubble discharge port and that generates bubbles.

The bubble generating unit may further include a pressure reduction region which is disposed between the bubble nozzle and the bubble discharge port, and reduces pressure of the bubbles that pass through the bubble nozzle.

The bubble body may include: a first body which has a first side at which the bubble inlet port is disposed; and a second body which has a first side to which the second side of the first body is detachably coupled, and the second side at which the bubble discharge port is disposed.

An inclined region may be disposed at the first side of the inner body and has one area expanding in diameter in a direction toward the dissolving cap.

The first end of the inner body may protrude in a radial direction of the inner body, and may be held and supported by the open side of the outer body.

The dissolving cap may further include an expanding flow path which is disposed at the first end of the dissolving inlet port facing the inner body, and expands in diameter to conform to a hemispheric shape of the dissolving cap.

The dissolving unit may be disposed between the housing and the tub.

The bubble generating unit may further include a bubble check valve which is disposed between the bubble inlet port and the bubble nozzle and guides the water/air mixture supplied from the bubble inlet port to the bubble nozzle.

Another exemplary embodiment of the present disclosure provides a washing machine including: a housing; a tub which is installed in the housing; a dissolving unit which stores air therein, and mixes water supplied from the outside with inside air so that the stored air is dissolved in the supplied water; and a bubble generating unit which generates bubbles by using the water/air mixture introduced from the dissolving unit, and supplies the bubbles to a lower side of the tub.

Yet another exemplary embodiment of the present disclosure provides a washing machine including: a housing; a tub which is installed in the housing; a dissolving unit which stores air therein, and mixes water supplied from the outside with inside air so that the stored air is dissolved in the supplied water; and a bubble generating unit which generates bubbles by using the water/air mixture supplied from the dissolving unit, and supplies the bubbles to an upper side of the tub.

According to the exemplary embodiments of the present disclosure, the washing machine generates and uses bubbles to improve cleaning performance. The bubbles can penetrate the laundry and decrease surface tension between the laundry and detergent or foreign substances remaining on the laundry, thereby effectively facilitating removal of the detergent or foreign substances undesirably adherent to the laundry.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 1 is a view illustrating an exemplary washing machine according to a first embodiment of the present disclosure.

FIG. 2 is a view illustrating cross sections of the exemplary dissolving unit and the exemplary bubble generating unit in FIG. 1.

FIG. 3 is a view illustrating cross sections of an exemplary dissolving unit and an exemplary bubble generating unit of an exemplary washing machine according to a second embodiment of the present disclosure.

FIG. 4 is an exploded perspective view of the dissolving unit in FIG. 1.

FIG. 5 is a view illustrating the exemplary discharge check valve in FIG. 1.

FIG. 6 is a view illustrating the exemplary air supply check valve in FIG. 1.

FIG. 7 is a view illustrating a cross section of the exemplary bubble generating unit in FIG. 1.

FIG. 8 is a view illustrating a cross section of an upper portion of the exemplary dissolving unit in FIG. 3.

DETAILED DESCRIPTION

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Hereinafter, exemplary embodiments of the present disclosure will be described in detail with reference to the accompanying drawings so that those skilled in the technical field to which the present disclosure pertains may easily carry out the exemplary embodiments. The present disclosure may be implemented in various different ways, and is not limited to the exemplary embodiments described herein.

In several exemplary embodiments, constituent elements having the same configuration will be representatively described using the same reference numerals in a first exemplary embodiment, and a second exemplary embodiment will be described with regard to only constituent elements that are different from the constituent elements described in the first exemplary embodiment.

It is noted that the drawings are schematic, and are not illustrated based on actual scale. Relative dimensions and proportions of parts illustrated in the drawings are exaggerated or reduced in size for the purpose of clarity and convenience in the drawings, and any dimension is merely illustrative but not restricting. The same reference numerals designate the same structures, elements or components illustrated in two or more drawings in order to exhibit similar characteristics.

Exemplary drawings of the present disclosure illustrate ideal exemplary embodiments of the present disclosure in more detail. As a result, various modifications of the drawings are expected. Therefore, the exemplary embodiments are not limited to specific forms in regions illustrated in the drawings, and for example, include modifications of form by manufacture.

Hereinafter, a washing machine 101 according to a first exemplary embodiment of the present disclosure will be described with reference to FIGS. 1, 2, and 4 to 8.

As illustrated in FIG. 1, a housing 100 defines an exterior of the washing machine 101. A tub 200 is disposed in the housing 100, and stores washing water for washing laundry. More specifically, the tub 200 is a water storage tub that stores the washing water.

A drum 250, which accommodates the laundry, is disposed in the tub 200. A pulsator 260, which can stimulate a water flow inside the drum 250, is disposed at a lower side of the drum 250. A drive unit 270 is installed at a lower side of the housing 100, and the drive unit 270 provides rotational power to the pulsator 260 and the drum 250

As illustrated in FIG. 1, the washing machine 101 includes a dissolving unit 300 and a bubble generating unit 400.

The dissolving unit 300 can store air. More specifically, a hollow space is formed in the dissolving unit 300, and air may be stored in this space and maintain a predetermined air pressure. Water is supplied into the dissolving unit 300 from the outside. More specifically, the water supplied into the dissolving unit 300 is at least a part of the washing water to be stored in the tub 200. As illustrated in FIG. 1, the dissolving unit 300 of the washing machine 101 is disposed in the housing 100 and located closer to a lower side of the tub 200 than an upper side of the tub 200. Therefore, the dissolving unit 300 may be positioned inside the housing 100 without interfering with a suspension system which is disposed between the housing 100 and the tub 200 and used to reduce vibration in the tub 200.

That is, the water supplied into the dissolving unit 300 from outside the dissolving unit 300 is at least part of the washing water used to wash laundry.

Therefore, air stored in the dissolving unit 300 can be mixed with water in dissolving unit 300 to produce a water/air mixture.

The bubble generating unit 400 generates bubbles by using the water/air mixture supplied from the dissolving unit 300. More specifically, the bubble generating unit 400 generates bubbles as the water/air mixture is introduced into the bubble generating unit 400 from the dissolving unit 300, and the bubble generating unit 400 supplies generated bubbles into the tub 200.

As water and bubbles are mixed together in the water supplied into the tub 200 through the bubble generating unit 400, surface tension between the laundry and detergent or foreign substances adherent to the laundry can be decreased. As a result, the detergent or foreign substances may be removed from the laundry more effectively. Therefore the washing machine 101 may effectively prevent the occurrence of irritating skin conditions to a person such as atopic dermatitis caused by the detergent or foreign substances remaining on the laundry.

As illustrated in FIG. 2, the dissolving unit 300 according to the first exemplary embodiment of the present disclosure may include an outer body 310, an inner body 320, a dissolving cap 330, and a dissolving guide port 311.

The outer body 310 may be open at the first side, and may have a hollow interior. As an example, the outer body 310 may be formed to have a hollow shape having a cross section having approximately a "U" shape in which a lower portion of the outer body 310 is formed in a hemispheric shape, and an upper portion of the outer body 310 is open.

Like the outer body 310, the first side of the inner body 320 may be open, and the second side (opposite to the first side) may be in a hemispheric shape. The inner body 320 may be disposed inside the outer body 310. Further, an outer circumferential surface of the inner body 320 may be disposed to be spaced apart from an inner circumferential surface of the outer body 310. The gap between the outer body and the inner body forms a dissolving flow path. More specifically, the first side of the inner body 320 may be supported by the first side of the outer body 310.

The dissolving cap 330 may be coupled to the first side of the outer body 310. More specifically, the dissolving cap 330 is formed approximately in a hemispheric shape, and may cover the open side of the outer body 310. Therefore, with the hemispheric shape of the dissolving cap 330 and the hemispheric shape of the lower portion of the outer body 310, air may be effectively retained in the dissolving unit 300. A dissolving inlet port 331 may be formed in the dissolving cap 330. The dissolving inlet port 331 may guide water supplied from the outside to the inner body 320.

A porous portion 321 may be formed in one area of the inner body 320. The porous portion 321 may guide at least some of the water introduced into the inner body 320 through the dissolving inlet port 331 so that this water merges with water currently introduced through the dissolving inlet port 331 and then flows into the dissolving flow path. The porous portion 321 may be formed in one area at the first side of the inner body 320 or one area of the outer circumferential surface of the inner body 320.

More specifically, the porous portion 321 may be formed in one area of the inner body 320 proximate to the dissolving inlet port 331. As an example, the porous portion 321 may have a plurality of openings formed in a circumferential direction of the inner body 320. That is, the porous portion 321 may be formed at an upper side of the inner body 320 and positioned close to the dissolving inlet port 331.

Water introduced into the dissolving inlet port 331 may flow into the interior of the inner body 320, and may overflow from the interior of the inner body 320 through the porous portion 321 to the dissolving flow path and away from the dissolving inlet port 331. More specifically, water supplied into the dissolving inlet port 331 may be mixed with air stored in the dissolving unit 300 while flowing in the inner body 320 and along the dissolving flow path.

In other words, without a separate agitating device or a separate mixing member, water introduced into the dissolving inlet port 331 of the dissolving unit 300 may be effectively mixed with air stored in the dissolving unit 300 while flowing into the interior of the inner body 320 in the dissolving unit 300 and along the dissolving flow path.

The dissolving guide port 311 may be formed at the second side (opposite to the first side) of the outer body 310. The dissolving guide port 311 may guide water passing through the dissolving flow path to flow to the bubble generating unit 400.

As illustrated in FIG. 2, water passes the dissolving inlet port 331 and enters the inner body 320, thereby increasing the water level in the dissolving unit. In this case, the water, which is continuously introduced into the dissolving inlet port 331, may flow toward the first side of the inner body 320 along an inner wall of the inner body 320 while merging with water introduced into the inner body 320. Water flowing along the inner wall of the inner body 320 can flow into the dissolving flow path through the porous portion 321. Water introduced into the dissolving flow path flows toward the second side of the outer body 310 along the dissolving flow path.

That is, water introduced into the dissolving inlet port 331 merges with water stored in the inner body 320 while flowing in the first direction of the longitudinal direction of the inner body 320, and flows in the second direction of the longitudinal direction of the inner body 320, and overflows through the porous portion 321, and then flows in the first direction of the longitudinal direction of the inner body 320 along the dissolving flow path. During the course of this water flow, air may be effectively dissolved in the water.

As illustrated in FIG. 8, the dissolving unit 300 according to the exemplary embodiment of the present disclosure may further include an inclined region 323.

The inclined region 323 may be formed in one area at the first side of the inner body 320. The inclined region 323 on the inner body 320 is adjacent to the dissolving cap 330 and expands in diameter in a direction toward the dissolving cap 330. More specifically, the inclined region 323 may be formed such that one area at the first side of the inner body 320 is inclined in a direction toward the inner circumferential surface of the outer body 310.

That is, the inclined region 323 may be a region of the inner body 320 which is disposed to be adjacent to the dissolving cap 330.

Therefore, the water introduced into the inner body 320 through the dissolving inlet port 331 may effectively flow into the inner body 320 without flowing to the inner circumferential surface of the outer body 310. Water introduced through the dissolving inlet port 331 is effectively mixed with the supplied water by coming into contact with the inclined region 323, and as a result, the air may be effectively dissolved in the supplied water.

As illustrated in FIG. 8, the dissolving unit 300 according to the exemplary embodiment of the present disclosure may further include the porous portion 321.

The porous portion 321 may be formed in the inner body 320. The porous portion 321 may guide the water introduced into the inner body 320 and allows water to overflow to the dissolving flow path. More specifically, the porous portion 321 may be formed in the inclined region 323 of the inner body 320. That is, the porous portion 321 may have a plurality of holes formed in the inclined region 323 in the circumferential direction of the inner body 320.

The water introduced into the inner body 320 is stored in the inner body 320, and thus the water lever in the inner body 320 may increase. In this case, the water, which is continuously introduced into the dissolving inlet port 331, merges with the water stored in the inner body 320, and the water may flow along the inner body 320. As the water surface reaches the first side of the inner body 320, it may overflow to the dissolving flow path through the porous portion 321. Water flows downwards in the dissolving flow path.

Therefore, the porous portion 321 guides water introduced into the dissolving unit 300 to allow the water to flow to the inner body 320, the outer body 310, and the dissolving flow path between the inner body 320 and the outer body 310, thereby enabling air stored in the dissolving unit 300 to be effectively dissolved in water. That is, the dissolving unit 300 may effectively dissolve air in water without need of a separate agitating device.

As an example, as illustrated in FIG. 8, the plurality of openings formed in the porous portion 321 may be approximately rectangular and have long sides extending in the longitudinal direction of the inner body 320.

As illustrated in FIG. 8, in the dissolving unit 300 according to the exemplary embodiment of the present disclosure, the first end of the inner body 320 may be held and supported by the first side of the outer body 310.

The first end of the inner body 320 may be an end tip of the inner body 320, that is, may be a tip at the first side of the inner body 320. The first end of the inner body 320 may protrude in a radial direction of the inner body 320. A diameter of the first end of the inner body 320 is larger than an inner diameter of the outer body 310, and thus the first end of the inner body 320 may be supported by the open side of the outer body 310. That is, the first end of the inner body 320 may be supported by the top edge of the first side of the outer body 310.

Therefore, the first end of the inner body 320 protrudes in the radial direction of the inner body 320, such that the outer circumferential surface of the inner body 320 may be spaced apart from the inner circumferential surface of the inner body 320 to form the dissolving flow path.

As illustrated in FIG. 8, the dissolving unit 300 according to the exemplary embodiment of the present disclosure may further include an expanding flow path 335.

More specifically, the dissolving cap 330 may include the expanding flow path 335. The expanding flow path 335 may be formed at the first end of the dissolving inlet port 331. The expanding flow path 335 may be formed such that a portion of the expanding flow path 335, which faces the inner body 320, expands in diameter along the hemispheric contour of the dissolving cap 330.

More specifically, the expanding flow path 335 is formed at the first end of the dissolving inlet port 331 which faces the inner body 320, and may be formed to expand in diameter toward the inner body 320 along the hemispheric contour of the dissolving cap 330.

Therefore, water supplied into the dissolving inlet port 331 may be effectively sprayed into the dissolving unit 300 along the expanding flow path 335, advangeously offering increased contact area between the water and the air stored in the dissolving unit 300.

The outer body 310 according to the exemplary embodiment of the present disclosure may further include the dissolving guide port 311. The dissolving guide port 311 may be formed at the second side of the outer body 310 and protrude from the circumferential direction of the outer body 310. That is, the dissolving guide port 311 may guide the water/air mixture, which is produced as the stored air and the introduced water are mixed through the dissolving flow path in the dissolving unit 300. The water/air mixture is discharged to the outside of the dissolving unit 300.

The dissolving unit 300 of the washing machine 101 may further include a drain hole 315 and a valve accommodating protrusion 351.

The first side of the outer body 310 is open, and the drain hole 315 is formed at the second side of the outer body 310. That is, the outer body 310 may have a cross section having approximately a "U" shape, and thus may define a space to store fluid therein. Therefore, a front side at the first side of the outer body 310 is fully open, and the second side of the outer body 310 is formed in a hemispheric shape and may have the drain hole 315 smaller than the opening at the first side. For example, the drain hole 315 may be formed at the bottom of the second side of the outer body 310.

The valve accommodating protrusion 351 may surround the drain hole 315. The valve accommodating protrusion 351 may protrude in one area of the second side of the outer body 310 toward the outside in the longitudinal direction of the outer body 310. More specifically, the valve accommodating protrusion 351 may protrude in one area of the second side of the outer body 310 and surround the drain hole 315. That is, the valve accommodating protrusion 351 may have a hollow portion therein which communicates with the drain hole 315.

The washing machine 101 may further include a discharge check valve 350. As illustrated in FIG. 5, the discharge check valve 350 is installed at a lower side of the outer body 310, and may allow the drain hole 315 and the dissolving drain port 312 to selectively communicate with each other by selectively opening and closing the drain hole 315.

Therefore, water passing through the dissolving drain port 312, that is opened by the discharge check valve 350, may be effectively discharged to the outside of the tub 200 through a drain line 210.

The discharge check valve 350 may open and close the drain hole 315. More specifically, the discharge check valve 350 may be opened or closed in accordance with the air pressure in the interior enclosed by the dissolving cap 330 and the outer body 310 or based on a level of water supplied from the dissolving inlet port 331.

Therefore, since the dissolving unit 300 includes the discharge check valve 350 that may selectively open and close the drain hole 315 formed in the outer body 310, the dissolving unit 300 can be protected from damage due to frozen residual water if water is left in the dissolving unit 300 for extended time, e.g., during the winter.

As illustrated in FIG. 5, the discharge check valve 350 of the washing machine 101 may include a valve member 20, a valve cover member 10, and an elastic member 30.

The first end portion of the valve member 20 is inserted into the drain hole 315, and the second end portion (opposite to the first end portion) thereof is disposed in the valve accommodating protrusion 351. More specifically, the valve member 20 may selectively open and close the drain hole 315 by using the first end portion inserted into the drain hole 315. For instance, the first end portion of the valve member 20 may be inserted into and supported by the drain hole 315.

The valve cover member 10 may be detachably coupled to an outer circumferential surface of the valve accommodating protrusion 351. The dissolving drain port 312 guides the water passing through the drain hole 315 to discharge water out of the outer body 310. More specifically, the valve cover member 10 may surround the outer circumferential surface of the valve accommodating protrusion 351, and may be detachably coupled to the valve accommodating protrusion 351. The valve cover member 10 may include the dissolving drain port 312 which is formed at a central portion of the valve cover member 10 and selectively communicates with the drain hole 315 through the valve member 20. That is, the valve member 20 may allow the dissolving drain port 312 and the drain hole 315 to selectively communicate with each other.

As an example, screw threads are formed on the outer circumferential surface of the valve accommodating protrusion 351, and screw threads, which are engaged with the screw threads of the valve accommodating protrusion 351, may be formed on the first surface of the valve cover member 10 which faces the outer circumferential surface of the valve accommodating protrusion 351.

The elastic member 30 may be disposed between the valve member 20 and the valve cover member 10. The elastic member 30 can provide elastic force to the valve member 20 and thereby enable the valve member 20 to open the drain hole 315.

The elastic member 30 may be compressed when the valve member 20 closes the drain hole 315, and may be expanded when the valve member 20 opens the drain hole 315.

As illustrated in FIG. 5, the valve member 20 of the dissolving unit 300 according to the exemplary embodiment of the present disclosure includes a valve hollow portion 21, and an outer diameter of the first end portion of the valve member 20 may be larger than a diameter of the drain hole 315.

The valve member 20 may include the valve hollow portion 21. The valve hollow portion 21 is a hollow portion formed at a center of the first end portion of the valve member 20. More specifically, the valve member 20 includes an elastic material such as rubber, and thus the valve member 20 may be inserted and installed into the drain hole 315 when it is deformed by an external force and by the valve hollow portion 21.

Based on the valve hollow portion 21, the outer diameter of the first end portion of the valve member 20 may be larger than the diameter of the drain hole 315. Therefore, since the valve member 20 includes the valve hollow portion 21, the first end portion of the valve member 20, which has a larger diameter than the drain hole 315, may be easily inserted and installed into the drain hole 315. That is, since the valve hollow portion 21 formed at a central portion of the valve member 20 may provide a deformable space so that the first end portion of the valve member 20 can be deformed by an external force, the valve member 20 may be assembled by being inserted and installed into the drain hole 315.

An outer diameter of the second end portion of the valve member 20 of the dissolving unit 300 according to the exemplary embodiment of the present disclosure may be larger than the diameter of the drain hole 315. A support groove 22 may be formed at the second end portion of the valve member 20.

An outer diameter of the second end portion of the valve member 20 may be larger than the diameter of the drain hole 315. More specifically, the outer diameter of the second end portion of the valve member 20 may be larger than the outer diameter of the first end portion of the valve member 20.

The support groove 22, which is concavely formed in the longitudinal direction of the valve member 20, may be formed at the second end portion of the valve member 20 which faces the inside of the valve cover member 10 in the longitudinal direction of the valve member 20. More specifically, the support groove 22 may be formed in a ring shape around a center of the valve member 20.

The support groove 22 may support the elastic member 30. More specifically, the first side of the elastic member 30 is at least partially inserted into the support groove 22, such that elastic force exerted by the elastic member 30 may be effectively transferred to the valve member 20.

As illustrated in FIG. 5, the valve cover member 10 of the dissolving unit 300 according to the exemplary embodiment of the present disclosure may include a catching protrusion 40.

The catching protrusion 40 may be formed inside the valve cover member 10. The catching protrusion 40 is disposed to be spaced apart from the dissolving drain port 312 of the valve cover member 10, and may protrude toward the valve member 20. The catching protrusion 40 supports an inner circumferential surface of the second side of the elastic member 30, thereby preventing the elastic member 30 from being withdrawn from the designated position between the valve cover member 10 and the elastic member 30 when the elastic member 30 is extended and contracted.

That is, the catching protrusion 40 supports an inner circumferential surface of the elastic member 30, such that the elastic member 30 may be positioned correctly inside the valve cover member 10.

As illustrated in FIG. 5, the valve cover member 10 of the dissolving unit 300 according to the exemplary embodiment of the present disclosure may further include a valve rib 12.

The valve rib 12 may be formed in the valve cover member 10. The valve rib 12 may be disposed between the catching protrusion 40 and a cover outer wall 11 coupled to the outer circumferential surface of the valve accommodating protrusion 351. More specifically, the valve cover member 10 includes the cover outer wall 11, which has screw threads formed on the inner circumferential surface and coupled to the outer circumferential surface of the valve accommodating protrusion 351. The dissolving drain port 312 is disposed at a central portion of the valve cover member 10.

The valve rib 12 is disposed on the valve cover member 10, and may circularly protrude between the dissolving drain port 312 and the cover outer wall 11 toward the outer body 310 or the valve member 20 along the center of the dissolving drain port 312. The valve rib 12 may be disposed between the catching protrusion 40 and the cover outer wall. That is, the valve rib 12 may be disposed farther from the dissolving drain port 312 than the catching protrusion 40. The valve accommodating protrusion 351 may be disposed between the valve rib 12 and the cover outer wall 11.

The discharge check valve 350 of the dissolving unit 300 may further include a first sealing member 60.

The first sealing member 60 may be installed between the cover outer wall 11 and the valve rib 12. The first sealing member 60 may maintain a water seal between the valve accommodating protrusion 351 and the valve cover member 10. More specifically, the first surface of the first sealing member 60 disposed between the valve rib 12 and the cover outer wall 11 may come into contact with the valve accommodating protrusion 351. Therefore, water can be prevented from leaking through the gap between the cover outer wall 11 and the outer circumferential surface of the valve accommodating protrusion 351.

The first sealing member 60 may effectively prevent air leak in the dissolving unit 300.

The outer body 310 of the dissolving unit 300 according to the exemplary embodiment of the present disclosure may further include support protrusions 352.

The support protrusions 352 may be disposed on the outer body 310. The support protrusions 352 may be formed on an outer circumference of the second side of the outer body 310 based on the drain hole 315. The support protrusions 352 protrude on the outer circumference of the outer body 310 in the longitudinal direction of the outer body 310, and a plurality of support protrusions 352 may be disposed and spaced apart from each other based on the drain hole 315.

More specifically, the support protrusions 352 may be disposed to face the second end portion of the valve member 20. When the valve member 20 opens the drain hole 315, the support protrusions 352 may effectively prevent the second end portion of the valve member 20, which is formed to have a diameter larger than the diameter of the drain hole 315, from closing the drain hole 315.

That is, when the valve member 20 opens the drain hole 315, the second end portion of the valve member 20 comes into contact with the first surface of the support protrusions 352, and the plurality of support protrusions 352 may guide water passing through the drain hole 315 so that the water can pass between the plurality of support protrusions 352.

As illustrated in FIG. 5, the discharge check valve 350 according to the exemplary embodiment of the present disclosure may further include a second sealing member 50.

The second sealing member 50 may be disposed between the first surface of the outer body 310 and the first surface of the cover outer wall 11 which faces the first surface of the outer body 310. More specifically, the second sealing member 50 is inserted and disposed in an accommodating groove in the first surface of the cover outer wall 11 which faces the outer body 310, and may effectively maintain a seal between the outer body 310 and the valve cover member 10.

The dissolving unit 300 of the washing machine 101 may further include the dissolving drain port 312.

The dissolving drain port 312 is formed at the second side of the outer body 310, and may be spaced apart from the dissolving guide port 311. More specifically, the dissolving drain port 312 may be formed at the bottom of the hemispheric shape of the outer body 310, and the dissolving guide port 311 may intersect the dissolving drain port 312.

When water stored in the outer body 310 (or a level of the water stored in the inner body 320 and the outer body 310) is at or greater than a predetermined amount, the dissolving drain port 312 may discharge the water through the drain line 210 of the tub 200. More specifically, the drain line 210 is installed at the lower side of the tub 200, and guides the washing water stored in the tub 200. The dissolving drain port 312 and the drain line 210 may be coupled through a pipe or a hose so that water passing through the dissolving drain port 312 may be discharged to the drain line 210 when the amount of water stored in the outer body 310 and the inner body 320 is equal to or greater than a predetermined amount. As an example, when water stored in the outer body 310 is at or above a predetermined amount, the control unit may determine that air currently remaining in the dissolving unit 300 cannot be effectively dissolved in the water introduced into the dissolving unit 300 because the air, which is stored in advance in the dissolving unit 300, is dissolved in the water already introduced in the dissolving unit 300 and then moves to the bubble generating unit 400. In this case, the control unit may stop the supply of water to the dissolving unit 300, and may allow the water stored in the dissolving unit 300 to be discharged out of the dissolving unit 300 through the dissolving drain port 312.

An inner hole 322 may be formed at the other hemispheric side of the inner body 320. The inner hole 322 is smaller than the opening on the first side of the inner body 320, and as a result, it is possible to prevent the water introduced into the dissolving inlet port 331 from flowing directly to the dissolving guide port 311 through the inner hole 322. The inner hole 322 may guide the water stored in the interior of the inner body 320 and the dissolving flow path formed between the outer body 310 and the inner body 320 so that the water is discharged to the drain line 210 of the tub 200 through the dissolving drain port 312 when the amount of water is equal to or larger than a predetermined amount.

As illustrated in FIG. 2, the dissolving unit 300 of the washing machine 101 may further include an air supply check valve 340.

The air supply check valve 340 may be installed on the dissolving cap 330. More specifically, the air supply check valve 340 may be installed on the dissolving cap 330 and spaced apart from the dissolving inlet port 331. The air supply check valve 340 is opened when the water is discharged to the drain line 210 of the tub 200 through the dissolving drain port 312, thereby allowing the outside air to flow into the inner body 320 and the outer body 310 of the dissolving unit 300. More specifically, the air supply check valve 340 is opened when the pressure in the dissolving unit 300 is equal to or lower than a preset pressure, thereby refilling the interior of the dissolving unit 300 with additional air. Thus, air is not supplied to the dissolving unit 300 from a separate tank or a separate pump which stores air. Rather, the air supply check valve 340 is opened and closed by the pressure in the dissolving unit 300, thereby introducing ambient air to the dissolving unit 300.

The water may be effectively discharged through the dissolving drain port 312 by the increased pressure contributed by the air introduced through the air supply check valve 340.

The air supply check valve 340 may guide air into the dissolving unit 300, and may prevent air in the dissolving unit 300 from leaking out. More specifically, the air supply check valve 340 may be opened when the pressure in the dissolving unit 300 is equal to or lower than the preset pressure to provide air to the interior of the dissolving unit 300. The air supply check valve 340 may be closed when the air pressure in the dissolving unit 300 is equal to or higher than the preset pressure. That is, the air supply check valve 340 may effectively prevent air stored in the dissolving unit 300 from leaking out of the dissolving unit 300.

Therefore, with air supply check valve 340, air pressure in the dissolving unit 300 can be controlled at a predetermined value or range to allow air to be effectively dissolved in water.

That is, the air supply check valve 340 may adjust the amount of air and thus the air pressure in the dissolving unit 300.

As illustrated in FIGS. 2 and 6, the dissolving unit 300 of the washing machine 101 may further include the air supply check valve 340.

The air supply check valve 340 may be installed on the dissolving cap 330. More specifically, the air supply check valve 340 may be installed on the dissolving cap 330 and spaced apart from the dissolving inlet port 331. The air supply check valve 340 is opened when the water is discharged to the drain line 210 of the tub 200 through the dissolving drain port 312, thereby allowing the outside air to flow into the inner body 320 and the outer body 310 of the dissolving unit 300. More specifically, the air supply check valve 340 is opened when the pressure in the dissolving unit 300 is equal to or lower than preset pressure, thereby allowing air to enter the dissolving unit 300.

The water may be effectively discharged through the dissolving drain port 312 by the increased pressure due to air introduced through the air supply check valve 340. More specifically, as illustrated in FIG. 6, the air supply check valve 340 may include communication holes 332, an air supply cover 341, and an air supply valve 347. The communication hole 332 may be formed in the dissolving cap 330. More specifically, the communication hole 332 may be spaced apart from the dissolving inlet port 331. An air supply airtightness member 348 is installed between the air supply cover 341 and the dissolving cap 330 to maintain an airtight seal in the dissolving unit 300.

As an example, the dissolving cap 330 formed with the communication hole 332 may protrude in a direction parallel to a longitudinal direction in which the dissolving inlet port 331 extends. That is, one area of the dissolving cap 330 may protrude in the direction parallel to the longitudinal direction of the dissolving inlet port 331, and the communication hole 332 may be formed in the protruding one area.

An air supply hole 342 may be formed at the first side of the air supply cover 341. The air supply hole 342 allows the outside air to enter the dissolving unit 300. An installation region 343 may be formed at the second side of the air supply cover 341. The installation region 343 may be a groove and is compatible with the second side of the air supply cover 341 which is concavely formed toward the air supply hole 342. That is, the installation region 343 may be formed such that the communication hole 332 and the air supply hole 342 can communicate with each other.

The air supply cover 341 may be coupled to the dissolving cap 330. More specifically, the air supply cover 341 may be coupled to the protruding one area of the dissolving cap 330 where the communication hole 332 is formed.

The air supply valve 347 may be installed in the installation region 343. The air supply valve 347 may allow the air supply hole 342 and the communication hole 332 to selectively communicate with each other in accordance with the internal pressure in the dissolving unit 300. More specifically, the air supply valve 347 may close the air supply hole 342 by the air pressure in the dissolving unit 300 when the internal pressure in the dissolving unit 300 is equal to or higher than the preset pressure. When the internal pressure in the dissolving unit 300 is lower than the preset pressure, the air supply valve 347 may allow the air supply hole 342 and the communication hole 332 to communicate with each other so that the interior of the dissolving unit 300 is refilled with the outside air. That is, the air supply valve 347 may allow the air supply hole 342 and the communication hole 332 to selectively communicate with each other in accordance with the internal pressure in the dissolving unit 300 without a separate electronic drive means. As an example, the air supply valve 347 may include an elastic material.

As illustrated in FIG. 6, the air supply check valve 340 according to the exemplary embodiment of the present disclosure may further include a valve support hole 336.

The valve support hole 336 may be formed in the dissolving cap 330. The valve support hole 336 may be spaced apart from the communication hole 332. The valve support hole 336 may support the air supply valve 347. That is, the air supply valve 347 may come into contact with the dissolving cap 330 and the air supply cover 341 between the valve support hole 336 and the air supply hole 342.

A plurality of communication holes 332 may be formed around the valve support hole 336. As an example, the communication holes 332 may be symmetrically disposed based on a central axis of the valve support hole 336. The central axis of the valve support hole 336 and a central axis of the air supply hole 342 may be coaxially formed.

That is, the installation region 343 formed in the air supply cover 341 may cover the plurality of communication holes 332.

As illustrated in FIG. 6, the air supply valve 347 according to the exemplary embodiment of the present disclosure may be formed such that a diameter of the first end portion of the air supply valve 347 is larger than a diameter of the second end portion of the air supply valve 347.

The first end portion of the air supply valve 347 may be larger than the air supply hole 342. More specifically, the first end portion of the air supply valve 347 may selectively come into contact with the air supply cover 341, thereby opening and closing the air supply hole 342.

The second end portion of the air supply valve 347 may be formed to be smaller than the diameter of the first end portion of the air supply valve 347. More specifically, the second end portion of the air supply valve 347 may be formed to cover the valve support hole 336.

A valve lip 344 has a thickness that decreases as the valve lip traverse away from a central portion of the air supply hole 342 and may be formed at the first end portion of the air supply valve 347. A valve protrusion 346 may be formed on the air supply valve 347 which faces the air supply hole 342. More specifically, one inclined surface of the valve lip 344 may be disposed to face the plurality of communication holes 332. That is, as the air stored in the dissolving unit 300 presses the inclined surface of the valve lip 344 through the communication hole 332, the first end portion of the air supply valve 347 may close the air supply hole 342, which can effectively prevent the stored air from leaking through the communication hole 332.

The air supply valve 347 according to the exemplary embodiment of the present disclosure may include an air supply protrusion 345. The air supply protrusion 345 may be disposed on the second end portion of the air supply valve 347. The air supply protrusion 345 may protrude toward the valve support hole 336.

Therefore, when the pressure in the dissolving unit 300 is lower than the preset pressure, the outside air supplied through the air supply hole 342 may pass between the first end portion of the air supply valve 347 and the installation region 343, and may be introduced into the dissolving unit 300 through the communication hole 332. In this case, the air supply protrusion 345 of the air supply valve 347 sits inside the valve support hole 336. This can prevent the air supply valve 347 from being displaced from the designed position by a flow velocity or pressure of air passing over the periphery of the air supply valve 347, and thereby can prevent the air supply valve 347 from hindering air flow to the communication hole 332.

As illustrated in FIG. 2, the bubble generating unit 400 of the washing machine 101 may include a bubble body 410 and a bubble nozzle 420.

The bubble body 410 may include a bubble inlet port 411 and a bubble discharge port 412. More specifically, the bubble inlet port 411 may be disposed at the first side of the bubble body 410 and coupled to the dissolving guide port 311. The bubble discharge port 412 may be formed at the second side of the bubble body 410.

The bubble nozzle 420 may be disposed inside the bubble body 410. The bubble nozzle 420 may have a bubble flow path 421 which has an inner diameter that increases as the bubble flow path traverses from the bubble inlet port 411 to the bubble discharge port 412. More specifically, the water/air mixture, which is introduced into the bubble inlet port 411, may be deaerated while passing through the bubble flow path 421, thereby generating bubbles.

As an example, a single or a plurality of bubble flow paths 421 may be formed in the bubble nozzle 420. That is, one or more bubble flow paths 421 may be formed in the bubble nozzle 420.

Therefore, with the bubble nozzle 420 having the bubble flow path 421, the bubble generating unit 400 may effectively generate bubbles by using the water/air mixture.

As illustrated in FIG. 2, the bubble generating unit 400 of the washing machine 101 may further include a pressure reduction region 440.

The pressure reduction region 440 may be disposed in the bubble body 410 between the bubble nozzle 420 and the bubble discharge port 412. The pressure reduction region 440 may have a larger diameter than the first side of the bubble flow path 421 which is disposed closer to the bubble discharge port 412 than the bubble inlet port 411. For example, the interior of the bubble body 410 having the pressure reduction region 440 may have a diameter larger than the sum of sizes of the first side of all the bubble flow paths 421.

Pressure of the bubbles can be reduced in the pressure reduction region 440 while passing through the bubble flow path 421. The bubbles may then be supplied into the tub 200 through the bubble discharge port 412.

As illustrated in FIG. 2, the bubble generating unit 400 of the washing machine 101 may further include a bubble check valve 430.

The bubble check valve 430 may be disposed between the bubble inlet port 411 in the bubble body 410 and the bubble nozzle 420. The bubble check valve 430 may allow the water/air mixture to flow from the bubble inlet port 411 to the bubble nozzle 420. The bubble check valve 430 may also block a flow of a fluid introduced into the bubble inlet port 411 from the bubble discharge port 412.

The bubble check valve 430 opens the bubble inlet port 411 by pressure from the water/air mixture (or the fluid) that is introduced into the bubble inlet port 411. Thus, the mixture can pass through the bubble flow path 421 disposed in the bubble nozzle 420. When fluid is supplied from the bubble discharge port 412 and flows to the bubble inlet port 411, the bubble check valve 430 closes the bubble inlet port 411, thereby preventing fluid from being supplied into the dissolving unit 300.

Bubbles generated by the bubble generating unit 400 and water including the bubbles may be supplied to the lower side of the tub 200, as illustrated in FIG. 2.

Therefore, bubbles and water including bubbles may be advantageously introduced into the drum 250 which is disposed in the tub 200 of the washing machine 101 and accommodates the laundry. Therefore, the bubbles generated by the bubble generating unit 400 and the water including the bubbles may be supplied to a lower side of the laundry accommodated in the drum 250. The bubbles are used to facilitate removal of residual detergent or foreign substances adherent to the laundry.

When bubbles and the water including bubbles are supplied to the lower side of the tub 200, the bubbles and the water pass through the washing water which is supplied to an upper side of the tub 200 and introduced and stored into the drum 250 and the tub 200, thereby more generating additional bubbles.

As illustrated in FIG. 7, the bubble body 410 of the washing machine 101 according to the exemplary embodiment of the present disclosure may include a first body 415 and a second body 416.

The bubble inlet port 411 may be disposed at the first side of the first body 415. The first side of the second body 416 is detachably coupled to the second side of the first body 415. More specifically, screw threads may be disposed on an outer circumferential surface of the second side of the first body 415. Screw threads may also be disposed on an inner circumferential surface at the first side of the second body 416 and may be engaged with the screw threads on the outer circumferential surface of the first body 415.

The bubble discharge port 412 may be disposed at the second side of the second body 416. More specifically, the bubble inlet port 411 and the bubble discharge port 412 may be coaxial. That is, the bubble nozzle 420 may be disposed between the second side of the first body 415 and the first side of the second body 416.

Therefore, the water/air mixture introduced through the bubble inlet port 411 of the first body 415 can, produce bubbles when flowing through the bubble flow path 421 of the bubble nozzle 420. The generated bubbles may be discharged to the outside of the bubble generating unit 400 through the bubble discharge port 412 of the second body 416.

The first body 415 and the second body 416 may be detachably coupled to each other. If a foreign substance or the like is trapped in the bubble flow path 421 disposed in the bubble nozzle 420, a user can conveniently remove it by decoupling the first body 415 and the second body 416. During manufacturing or installation, the first body 415, the second body 416, and the bubble nozzle 420 may be advantageously and efficiently assembled together.

As illustrated in FIG. 7, the bubble nozzle 420 according to the exemplary embodiment of the present disclosure may be disposed the first side of the first body 415 and the second side of the second body 416.

The bubble flow path 421 may be disposed at the first side of the bubble nozzle 420. An outer circumferential surface at the first side of the bubble nozzle 420 may face an inner circumferential surface of the first body 415.

The second side of the bubble nozzle 420 may be hollow. An outer circumferential surface at the second side of the bubble nozzle 420 may face an inner circumferential surface of the second body 416. The first side of the bubble nozzle 420 has a smaller diameter than its second side. Therefore, the inner circumferential surface at the second side of the first body 415 may face the outer circumferential surface at the first side of the second body 416 as well as the outer circumferential surface at the first side of the bubble nozzle 420.

Since the second side of the bubble nozzle 420 is hollow, the bubble flow path 421 disposed at the first side of the bubble nozzle 420 and the bubble discharge port 412 disposed at the second side of the second body 416 may communicate with each other.

As illustrated in FIG. 4, the bubble generating unit 400 according to the exemplary embodiment of the present disclosure may further include a nozzle sealing member 450 disposed between the second side of the first body 415 and the second side of the bubble nozzle 420.

The nozzle sealing member 450 is disposed between the outer circumferential surface at the first side of the bubble nozzle 420 and the inner circumferential surface of the second body 416. The nozzle sealing member 450 may prevent bubbles from leaking through the gap between the first body 415 and the second body 416.

Hereinafter, a washing machine 102 according to a second exemplary embodiment of the present disclosure will be described with reference to FIG. 3. The washing machine 102 according to the second exemplary embodiment of the present disclosure includes the same configurations of the dissolving unit 300 and the bubble generating unit 400 included in the washing machine 101. That is, the washing machine 102 according to the second exemplary embodiment of the present disclosure is similar to the washing machine 101 according to the first exemplary embodiment, but differ with respect to the coupling mechanism between the bubble generating unit 400 and the tub 200.

Water including bubbles generated by the bubble generating unit 400 of the washing machine 102 may be supplied to the upper side of the tub 200, e.g., through a nozzle jet 220 that supplies the washing water into the tub 200 of the washing machine 102. The nozzle jet 220 may be disposed in the housing 100 at the upper side of the tub 200 of the washing machine 102.

Hereinafter, an operational process of the washing machine 101 will be described with reference to FIGS. 1, 2, and 4 to 8.

Washing water is supplied into the tub 200 in a washing mode or a rinsing mode of the washing machine 101, e.g., through the upper side of the tub 200 and to the dissolving unit 300. Washing water supplied into the dissolving unit 300 is mixed with the air stored in the dissolving unit 300.

Once supplied through the air supply check valve 340 when the pressure in the dissolving unit 300 is equal to or lower than a predetermined pressure, air may be contained in the dissolving unit 300.

Water supplied into the dissolving unit 300 flows along the interior of the dissolving unit 300 so that the air stored in the dissolving unit 300 is dissolved in the water. More specifically, water introduced through the dissolving inlet port 331 flows into the inner body 320 and is stored in a hollow interior of the inner body 320. In this case, the water, which is continuously supplied through the dissolving inlet port 331, and the water, which is already present in the hollow interior of the inner body 320, merge with each other and flow along the inner wall of the inner body 320. Water may overflow down the dissolving flow path between the inner circumferential surface of the outer body 310 and the outer circumferential surface of the inner body 320 through the porous portion 321.

Therefore, water introduced into the dissolving unit 300 flows into the inner body 320 and along the dissolving flow path between the inner body 320 and the outer body 310, and can be effectively mixed with air stored in the dissolving unit 300 without using a separate pump or agitating device.

The water/air mixture in the dissolving unit 300 may be supplied into the bubble generating unit 400 through the dissolving guide port 311. More specifically, the bubble check valve 430 disposed in the bubble body 410 is opened by pressure from the water/air mixture, and the water/air mixture is guided to the bubble nozzle 420 through the bubble inlet port 411.

The water/air mixture passes through the bubble flow path 421 formed in the bubble nozzle 420. The bubble flow path 421 has an inner diameter that increases as the bubble flows path traverses from the bubble inlet port 411 to the bubble discharge port 412. During the flow course, air is separated from the water/air mixture, thereby generating bubbles. Fine micro bubbles may be generated, the sizes of which are determined by a diameter of the bubble flow path 421 and the number of bubble flow paths 421.

Pressure of the bubbles can be reduced in the pressure reduction region 440 while passing through the bubble flow path 421. The bubbles may then be advantageously supplied into the tub 200 through the bubble discharge port 412.

More specifically, water including bubbles is supplied to the laundry accommodated in the drum 250 from the lower side of the tub 200. Washing water is also supplied to the upper side of the tub 200. Due to the bubbles, detergent and foreign substances remaining on the surface of the laundry may be removed from the laundry more effectively. Bubbles supplied to the lower side of the tub 200 pass through the washing water which is supplied to the upper side of the tub 200 and stored in the tub 200. Thus, the laundry accommodated in the drum 250 and the bubbles supplied through the lower side of the tub 200 encounter and interact. As a result, residual detergent or foreign substances on the surface of the laundry may be effectively removed from the laundry.

The washing machine 101 may further include a water level sensor and a control unit. More specifically, a water level sensor (not shown) or the like may be installed in the dissolving unit 300. The control unit can determine whether a preset or larger amount of water has been supplied into the dissolving unit 300 based on the current level of the water in the dissolving unit 300 as detected by the water level sensor.

If air in the dissolving unit is insufficient (e.g., due to air discharge out of the unit) to be effectively dissolved in the water supplied into the dissolving inlet port 331, the control unit stops the supply of water to the dissolving inlet port 331. In this case, the water/air mixture, which remains in the dissolving unit 300, is supplied into the bubble generating unit 400 through the dissolving guide port 311.

Thereafter, after the supply of water being supplied through the dissolving inlet port 331 is stopped, water in the dissolving unit is insufficient to open the bubble inlet port 411 by pressing the bubble check valve 430 of the bubble generating unit 400 and therefore is retained in the dissolving unit 300. In this case, water remaining in the inner body 320 is collected, through the inner hole 322 formed at the other hemispheric side of the inner body 320, in the dissolving flow path between the hemispheric side of the inner body 320 and hemispheric side of the outer body 310.

The discharge check valve 350, which is disposed at the hemispheric side of the outer body 310, is opened based on the level (pressure) of the water remaining in the dissolving unit 300. More specifically, the water remaining in the inner body 320 is discharged through the inner hole 322 formed at hemispheric side of the inner body 320, through the dissolving drain port 312, and then to the outside through the drain line 210. The drain line is installed at the lower side of the tub 200 and can discharge water in the tub 200 to the outside.

In this case, the air supply check valve 340 installed on the dissolving cap 330 is opened to guide air into the dissolving unit 300. With the introduced air, the remaining water may be more effectively pushed to the drain line 210 through the dissolving drain port 312.

When water remaining in the dissolving unit 300 is discharged and the dissolving unit 300 is filled with air, the air supply check valve 340 and the discharge check valve 350 are closed so that air is retained in the dissolving unit 300.

In a case in which bubbles need to be continuously supplied into the tub 200, the control unit restarts water supply to the dissolving inlet port 331. In the dissolving unit 300, water supplied into the dissolving inlet port 331 may be mixed with air in the dissolving unit 300, producing water/air mixture as described above.

Thereafter, the control unit may control a supply of washing water to the dissolving inlet port 331 based on detection by the water level sensor or preset washing and rinsing programs.

With the aforementioned configuration, the washing machine 101 may effectively generate bubbles by utilizing the water/air mixture and may advantageously supply the bubbles to the lower side of the tub 200, thereby facilitating removal of detergent and foreign substances undesirably adherent to the laundry during washing and rinsing operations. This can advantageously and effectively prevent the cleaned laundry from causing irritating skin diseases on persons who wear them, such as atopic dermatitis.

Hereinafter, an exemplary operational process of the washing machine 102 according to the second exemplary embodiment of the present disclosure is described with reference to FIG. 3.

The operations of the washing machine 102 are similar with the operations of the washing machine 101 as described above, but difference with respect to the process in which the bubbles are generated by the bubble generating unit 400 and then supplied into the tub 200 will be described.

Bubbles generated by the bubble generating unit 400 and water including bubbles are supplied into the tub 200 and the drum 250 through the nozzle jet 220 installed on the upper side of the tub 200 in the housing 100. More specifically, some washing water may be supplied to the upper side of the tub 200, and additional water including the bubbles may be supplied through the nozzle jet 220 installed at the upper side of the tub 200.

With the aforementioned configuration, the washing machine 102 may effectively generate bubbles by utilizing the water/air mixture and may supply generated bubbles to the upper side of the tub 200, thereby facilitating removal of detergent and foreign substances undesirably adherent to the laundry during washing and rinsing operations. This can advantageously and effectively prevent the cleaned laundry from causing irritating skin diseases on users who wear them, such as atopic dermatitis.

While the exemplary embodiments of the present disclosure have been described with reference to the accompanying drawings, those skilled in the art will understand that the present disclosure may be implemented in any other specific form without changing the technical spirit or an essential feature thereof.

Accordingly, it should be understood that the aforementioned exemplary embodiment is described for illustration in all aspects and is not limited, and the scope of the present disclosure shall be represented by the claims to be described below, and it should be construed that all of the changes or modified forms induced from the meaning and the scope of the claims, and an equivalent concept thereto are included in the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A washing machine comprising:

a tub configured to contain washing water;

a dissolving unit configured to: receive air and water from outside; and produce a water/air mixture therefrom; and a bubble generating unit coupled to the dissolving unit and configured to generate bubbles by using the water/air mixture supplied from the dissolving unit and supply the bubbles into the tub, wherein the dissolving unit comprises:

an outer body that is hollow and comprises a first side that is open;

an inner body disposed in the outer body and comprising a first side that is open, wherein the first side of the inner body protrudes in a radial direction of the inner body and is supported by the first side of the outer body, wherein a gap between the inner body and the outer body forms a dissolving flow path, wherein the inner body comprises an inclined region that is formed such that one area at the first side of the inner body is inclined in a direction toward an inner circumferential surface of the outer body, and a porous portion that have a plurality of holes formed in the inclined region in a circumferential direction of the inner body; and a dissolving cap coupled to the first side of the outer body and comprising a dissolving inlet port, wherein the dissolving inlet port is configured to receive water supplied to the dissolving unit.

2. The washing machine of claim 1, wherein the dissolving unit further comprises:

a dissolving guide port disposed in the outer body and configured to guide the water/air mixture to the bubble generating unit.

3. The washing machine of claim 2, wherein the dissolving unit further comprises a dissolving drain port disposed on the outer body and spaced apart from the dissolving guide port, wherein the dissolving drain port is configured to discharge water from the outer body to a drain line of the tub when an amount of water in the outer body is equal to or larger than a predetermined amount.

4. The washing machine of claim 3, wherein the dissolving unit further comprises an air supply check valve installed in the dissolving cap, wherein the air supply check valve is configured to open to introduce air to the dissolving unit when water is discharged from the dissolving unit to a drain line of the tub through the dissolving drain port.

5. The washing machine of claim 1, wherein the dissolving unit further comprises:

a drain hole disposed at a second side of the outer body; and a valve accommodating protrusion surrounding the drain hole and protruding out from the outer body, wherein the valve accommodating protrusion is disposed proximate to the second side of the outer body.

6. The washing machine of claim 5, further comprising:

a discharge check valve installed at the second side of the outer body, and configured to control an opening and closing of the drain hole.

7. The washing machine of claim 6, wherein the discharge check valve comprises:

a valve member comprising a first end portion inserted into and supported by the drain hole;

a valve cover member detachably coupled to an outer circumferential surface of the valve accommodating protrusion and comprising a dissolving drain port, wherein the dissolving drain port is configured to discharge the water/air mixture out of the outer body; and an elastic member disposed between the valve member and the valve cover member, and configured to provide an elastic force to the valve member.

8. The washing machine of claim 1, wherein the dissolving unit is configured to allow water to flow through the dissolving inlet port, flow along an inner wall of the inner body, and overflow from the inner body to the dissolving flow path through the porous portion, and wherein water is mixed with air contained in the dissolving unit.

9. The washing machine of claim 1, wherein the bubble generating unit comprises:

a bubble body comprising a bubble inlet port and a bubble discharge port; and a bubble nozzle disposed inside the bubble body and comprising a bubble flow path that has an inner diameter that increases as the bubble flow path traverses from the bubble inlet port to the bubble discharge port, wherein the bubble nozzle is configured to output bubbles.

10. The washing machine of claim 9, wherein the bubble generating unit further comprises a pressure reduction region disposed between the bubble nozzle and the bubble discharge port, and wherein the pressure reduction region is configured to reduce pressure of the bubbles that pass through the bubble nozzle.

11. The washing machine of claim 9, wherein the bubble body comprises:

a first body comprising a first side and a second side, wherein the bubble inlet port is disposed on the first side of the first body; and a second body comprising a first side and a second side, wherein the second side of the first body is detachably coupled to the first side of the second body, and the bubble discharge port is disposed on the second side of the second body.

12. The washing machine of claim 9, wherein the bubble generating unit further comprises a bubble check valve disposed between the bubble inlet port and the bubble nozzle, wherein the bubble check valve is configured to guide the water/air mixture to flow from the bubble inlet port to the bubble nozzle.

13. The washing machine of claim 1, wherein the inclined region has a diameter that increases in a direction toward the dissolving cap.

14. The washing machine of claim 1, wherein the dissolving cap further comprises an expanding flow path disposed at a first end of the dissolving inlet port facing the inner body, and wherein the expanding flow path expands in diameter in a direction toward the inner body and conforms to a hemispheric shape of the dissolving cap.

15. The washing machine of claim 1, wherein the dissolving unit is disposed between a housing of the washing machine and the tub.

* * * * *